US006220577B1

(12) United States Patent
Ostrow

(10) Patent No.: US 6,220,577 B1
(45) Date of Patent: Apr. 24, 2001

(54) TEMPORARY GUARD RAILING

(76) Inventor: Paul Ostrow, 269 Tennyson St., Thousand Oaks, CA (US) 91360

( * ) Notice: Subject to any disclaimer, the term of this patent is extended or adjusted under 35 U.S.C. 154(b) by 0 days.

(21) Appl. No.: 09/352,176

(22) Filed: Jul. 12, 1999

Related U.S. Application Data

(60) Provisional application No. 60/093,211, filed on Jul. 17, 1998.

(51) Int. Cl.[7] ..... E04H 17/14

(52) U.S. Cl. ..... 256/67; 256/65; 256/DIG. 1; 256/DIG. 6

(58) Field of Search ..... 256/59, 65, 68, 256/25, 26, 60, 67, DIG. 1, DIG. 2, DIG. 6; 182/113

(56) References Cited

U.S. PATENT DOCUMENTS

| | | | | |
|---|---|---|---|---|
| 3,336,004 | * | 8/1967 | Edie et al. | 256/65 |
| 3,776,521 | | 12/1973 | Weinert | 256/24 |
| 4,015,827 | * | 4/1977 | Brand | 256/59 |
| 4,030,255 | * | 6/1977 | Hartman | 256/67 X |
| 4,620,612 | * | 11/1986 | Enoki et al. | 182/113 |
| 4,666,131 | * | 5/1987 | Kettelkamp, Sr. et al. | 256/59 |
| 4,787,475 | | 11/1988 | Arteau et al. | 182/82 |
| 5,145,153 | | 9/1992 | Glynn | 256/59 |
| 5,314,167 | * | 5/1994 | Holloman | 256/69 |
| 5,560,588 | | 10/1996 | Hilliard | 256/65 |
| 5,683,074 | | 11/1997 | Purvis et al. | 256/67 |
| 5,803,647 | * | 9/1998 | Hughes | 256/65 X |

FOREIGN PATENT DOCUMENTS

| | | | | |
|---|---|---|---|---|
| 572556 | * | 2/1976 | (CH) | 256/67 |
| 2425506 | * | 12/1975 | (DE) | 256/65 |
| 2173527 | * | 10/1986 | (GB) | 256/67 |

* cited by examiner

*Primary Examiner*—Harry C. Kim
(74) *Attorney, Agent, or Firm*—Ralph D. Chabot

(57) ABSTRACT

A temporary guard rail system for use during building construction which utilizes a flex joint which incorporates a heavy duty spring. The flex joint is slidably mounted to the ends of adjacent rail members. Utilization of the flex joint permits guard rails to be installed in varied orientations and is not limited to use on a horizontal plane.

9 Claims, 2 Drawing Sheets

TEMPORARY GUARD RAILING

This application claims priority under 35 U.S.C. Section 119(e) to a provisional application filed Jul. 17, 1998 bearing Ser. No. 60/093,211.

TECHNICAL FIELD

This invention relates to safety devices and more specifically to temporary guard railings used during construction of buildings.

BACKGROUND-DESCRIPTION OF PRIOR ART

In the construction of multiple-story buildings, both commercial and residential, considerable risk is present to craftsmen and others at the building site during the main stages of construction. Specifically, there is considerable risk that workers may accidentally fall from an upper story and sustain a serious injury or even death. These concerns are especially high until exterior walls are installed around elevated floors and until a permanent bannister or railing system is installed on balconies, staircases and the like.

Regulations of the Occupational, Safety and Health Administration (OSHA), require the use of safety protection at locations where a risk is present that persons may fall. To satisfy OSHA regulations, safety protection in the form of temporary guard rails must exceed certain minimum lateral load requirements without experiencing permanent deformation or component failure.

Numerous temporary guard rails have been designed to address these safety concerns. Over time, designs for guard rails have improved structurally. However, some building designs have features which require railings to angled in different directions and/or orientations. Especially for these situations, installation of guard rails has proven cumbersome and requires additional time because of the changes in vertical height and horizontal direction.

Typical of the prior art is U.S. Pat. No. 3,776,521 issued to Weinert. Weinert discloses a portable safety railing for use in a horizontal plane which can be connected lengthwise in series or connected at right angles.

U.S. Pat. No. 5,683,074 issued to Purvis et al., discloses a guard rail system which incorporates a plurality of upright stanchions. Attached to the stanchions are support collars which support side rails and also permit the rails to be rotated 360 degrees about the stanchion. Once the proper angle is obtained, the support collars are fixed in position by use of wing nuts. The wing nuts are also used along with an incline adapter bracket to angle side rails vertically. Finally, Purvis et al., teaches the use of adjusting side rail length by the use of a telescopic means. One concern of this system is that failure of a wing nut can compromise the integrity of the guard rail.

SUMMARY OF THE INVENTION

The present invention provides a temporary guard rail assembly designed so that it can be quickly installed for a variety of situations and provide the necessary guard rail function. The safety stanchion post assembly meets OSHA requirements and is adapted for building construction use as a temporary rail system installed when framing of a building is finished and removed as the installation of walls and permanent railings near completion.

Accordingly, the present invention is directed to a safety stanchion post assembly which comprises: a) a flat mounting plate fabricated to rest on a support surface or flooring; b) an upright post fixed in a vertical relationship on the mounting plate and having a pair of brackets permanently attached at different distances from the mounting plate; and c) means for attaching the mounting plate upon the support surface.

At least two stanchion post assemblies are used in series to support an upper and a lower rail system. Each rail system comprises a plurality of rails coupled in series to adjacent rails on either end by a coupling which can be described as a flex joint. In this specification, I use flex joint and coupling interchangeably and both have the same meaning. My coupling permits flexibility in allowing each rail to be orientated in a variety of directions respective to an adjacent rail. An adjacent rail is defined as a rail which is capable of being coupled to the rail. Each rail system will be supported by a respective bracket on each stanchion post assembly. Each rail comprises an outer elongated member and an inner elongated member which is capable of telescopically extending away from the outer member resulting in a rail whose length can be varied.

The unique flex joint is coupled on one end to the outer member of one rail and coupled on the other end to the inner member of an adjacent rail.

Preferably, the upright post or stanchion has two brackets permanently fixed to the post at vertical distances of 42 inches and 21.5 inches from the base of the mounting plate. The brackets can be L-shaped or U-shaped. However, U-shaped is more desirable since it can be secured to the side of the upright post more securely because of a greater available weld area. Also, the distal side of either the U or L shape bracket is preferably longer than the outside diameter of the rail to help maintain the rail on the bracket.

The means for permanently affixing the brackets is by welding to the stanchions.

Each bracket has a hole which is on the bracket wall affixed to the stanchion. A pair of holes are made transversely through the sidewall of the post so that the post holes are in line with the bracket hole and the distal side of a respective bracket. A fastener in the form of a set screw threadably engages at least one of the holes and is partially positioned between the post holes. Preferably, the post hole distal from each respective bracket is larger than the head of the set screw or fastener. This is so that as each rail is frictionally engaged by a set screw, the head will have its position within the post or no more than flush with the post. In this way, persons walking close to each post will not have their clothing snag on a protruding screw head. Also, there is less of a chance that passers-by may wish to try unscrewing the set screws when they are out of sight.

When a rail is placed upon a pair of brackets, the fasteners are then used to secure the rail in place. Sufficient torque is used upon the fasteners to ensure the rails remain secure.

The bracket design insures that even if a fastener should fail, the rail system will not be displaced off of its position on each bracket.

The brackets can also be fitted with a removably attached flat plate or pin positioned above the rail to enclose the rail within the bracket thereby preventing the rail from being inadvertently lifted out from supportable engagement with the bracket. However, because of the weight of the rail members, it is believed this enclosure means is not necessary to the overall function of the invention.

The mounting-plate has four holes defined therein along the peripheral corner of the plate and is preferably spaced in relationship to one another. The plate is fastened to the support surface by lag screws that extend through the openings in the mounting plate.

The rails can be made of various lengths and each have a slidable inner member that permits each rail to have an adjustable length. This type of variable length can be used to close gaps in order to meet the OSHA required maximum allowable opening of three inches. Although diameters can vary, my invention utilizes a 1½ inch diameter for the outer rail member and a 1¼ inch diameter for the inner member.

The rails are preferably made of a high strength material such as steel. The rail configuration is tubular and can be in either in the form of a round pipe or the more preferred square pipe configuration. For purposes of this specification I will use the term circumference to define the outer or exterior surface distance for square pipe as it is commonly used for round pipe.

Although rails can be of varying length, for my invention I preferably use three rail lengths: 1) a three foot length which can be extended up to five feet; 2) a five foot length which can be extended up to nine feet; and 3) an eight foot length which can be extended up to fifteen feet.

The inner member of the rail has a temporary attachment means such as a pole clip that allows the inner member to lock in place with the overlying outer rail member. Each outer rail member has an opening to allow for the pole clip to extend through in order to temporarily fasten the inner member to the outer member. The use of such a locking device is only for increasing the ease by which the rails are handled and transported to and from the site location. Without such a locking device, the inner member can slide out away from the outer member at an undesired time and make rail transport more difficult to manage.

The inner member, in its retracted and locked position, has its distal end protruding approximately three inches from the outer rail member. The protruding section of the inner member is necessary for proper slidable engagement to the flex joint as will be discussed below.

The flex joint or coupling allows for the interconnecting of rails and affords maximum flexibility to allow the rail system to adjust to any stairway configuration or floor perimeter. The flex joint couples adjacent rail members.

The flex joint or coupling comprises two rail coupling sections which are connected to a directional means.

The flex joint has a first rail coupling section which has a distal end having an inside diameter which is large enough for slidably receiving the distal end of an inner rail member. The second rail coupling section has a distal end having an outside diameter which is small enough to be slidably received within the distal end of an outer rail member. Each rail coupling section of the flex joint is a substantially hollow member.

One embodiment of the directional means incorporates the use of a heavy duty spring. The ends of the spring are attached to metal pins transversely positioned in the interior of each rail coupling section.

An alternative embodiment of the directional means incorporates the use of a rotatable hinge. The hinge is connected by a hinge pin which permits movement in one plane. However, the ends of the directional means distal from the hinge are each rotatably connected to a respective rail coupling section. The hinge can therefore be rotated into a desired orientation and then displaced upon the desired plane to achieve the desired position.

The purpose of the flex joint is two-fold. First, it provides a quick slidable attachment means to ends of adjacent rails. Second, the flex joint permits the overall rail system to be utilized in varying configurations and is not limited to a horizontal application.

The high tension spring embodiment insures a secure rail, even when acute angles are required for the rail system design. However, either embodiment can be additionally secured to rail members on either side by the use of set screws or the like.

Having described the main parts of my invention, the method of attachment will now be discussed.

The stanchions are first positioned and secured to the support surface or flooring through the use of fasteners such as lag screws or the like. Since the brackets are welded to the upright post, proper orientation of each stanchion is necessary to insure that the brackets are aligned with a similar reference; that reference is usually the edge of the flooring.

It is preferred to use two stanchions to support each upper and lower rail. Each rail is positioned and lowered into a respective bracket. Once the brackets support the weight of a rail, a securing means such as set screws located in the stanchion are used to frictionally engage the rail between the set screw on one side and the distal side of the bracket on the other. Because of the stanchion placement relative to one another, it may be necessary to extend the inner rail member before securing it to the bracket with a set screw. Once both the inner and outer rail members are secured within the brackets by the set screws, the flex joint can be slidably coupled to a rail end and then coupled to an adjoining rail end.

Before the flex joint is attached to adjacent rails, the inner and outer members of one rail are secured to brackets while usually only one member of the adjoining rail is secured. The flex joint is slidably coupled to the secured rail and then the unsecured rail is slidably moved as necessary to become coupled with the flex joint prior to the unsecured rail member being secured to the bracket with a set screw. From this it is readily apparent that aside from the slidable engagement, no other attachment means is utilized for securing the flex joint to the adjoining rail ends.

As described above, the flex joint has one end for sliding into an adjacent outer rail member while the other end of the flex joint slides over an adjacent inner rail member. It is readily apparent that the flex joint can also be made having ends of similar dimension so long as the ends of the inner and outer rail members have compatible similar dimension ends or exterior circumference. As an example, a flex joint can be made having ends which are designed to slide over the circumference of an inner rail member. The end of each outer rail member therefore, can be modified to have the same circumference as an inner rail member. This can be accomplished by securing a short-length attachment to the outer rail member which has the same circumference as the inner member.

These and other features and advantages of the present invention will become apparent to those skilled in the art upon reading the following detailed description in conjunction with the drawings provided.

DETAILED DESCRIPTION OF THE PREFERRED EMBODIMENT

Figure 1:
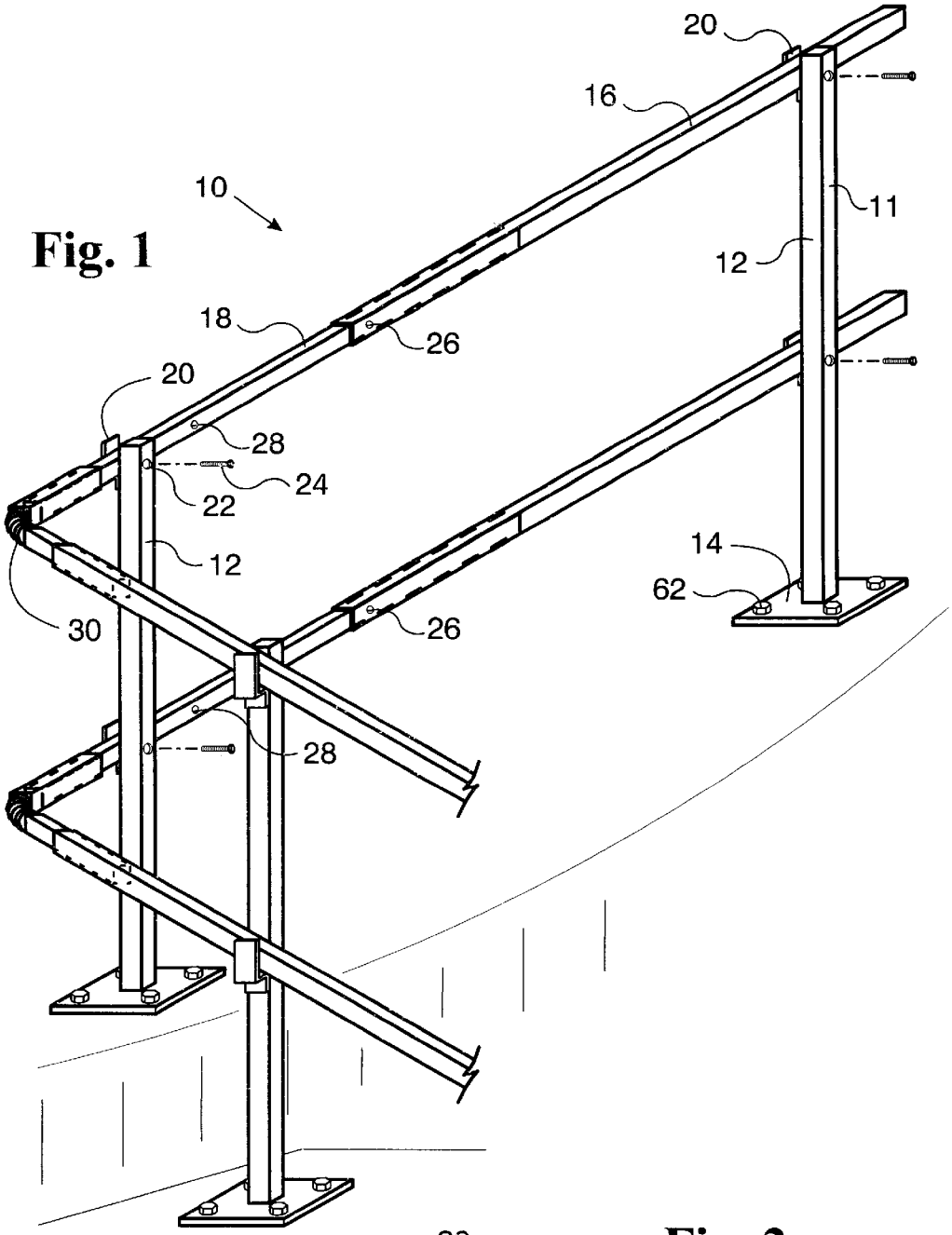
FIG. 1 illustrates a perspective view of a safety rail system of the present invention.

FIG. 1 provides a perspective view of my temporary guard railing 10. Each rail has a substantially square circumference and comprises two elongated sections; an outer rail 16 and an inner rail 18 partially disposed within outer rail 16. Inner rail 18 is a slidable member but in its retracted position, will still be partially exposed. Therefore, one rail will have two ends of varying outer circumference: a first end having the circumference of outer rail 16 and the second end having the circumference of inner rail 18.

Outer rail 16 has an aperture 26 while inner rail has one aperture (not indicated). As can be best shown in FIG. 4, a pole-clip 58 is attached to the inner wall of inner rail 18 and aligned so that the cylindrical stud 28 located at one end of pole-clip 58 can pass through the inner rail aperture and come into frictional contact with outer rail 16 due to the outward bias of pole-clip 58. Aperture 26 and stud 28 can be aligned with each other. When this happens, stud 28 will extend into aperture 26 thereby precluding further movement of inner rail 18 relative to outer rail 16. A downward displacement force is thereafter required to force stud 28 away from outer wall 16 and permit inner rail 18 to become slidable.

My invention also utilizes a plurality of stanchions 11 which are necessary for supporting each of the rails. Each stanchion 11 comprises an upright post 12, a base 14 attached to the bottom of post 12, and a pair of brackets 20.

Preferably, the bottom of post 12 is positioned on top of the center portion of base 14. A plurality of holes 60 extend through base 14. Lag screws 62 are then used to attach base 14 to the flooring or supporting surface.

Brackets 20 are substantially U-shaped and are permanently attached to the side of post 12. Both brackets 20 are positioned on the same side of post 12, one above the other. The distance between both brackets is preset to conform with the desired spacing between the upper rail system and the lower rail system.

Figure 4:
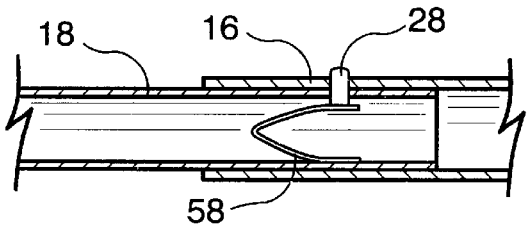
FIG. 4 is a cut-away view illustrating the use of a pole-lock pin.

Each bracket 20 has a hole which is aligned with a pair of holes 22 found on post 12. All three holes have a common axis of symmetry which will permit screw 24 to be inserted as shown in FIG. 1 and FIG. 4, threadably engage and partially extend into the space between the opposing faces of bracket 20.

Figure 2:
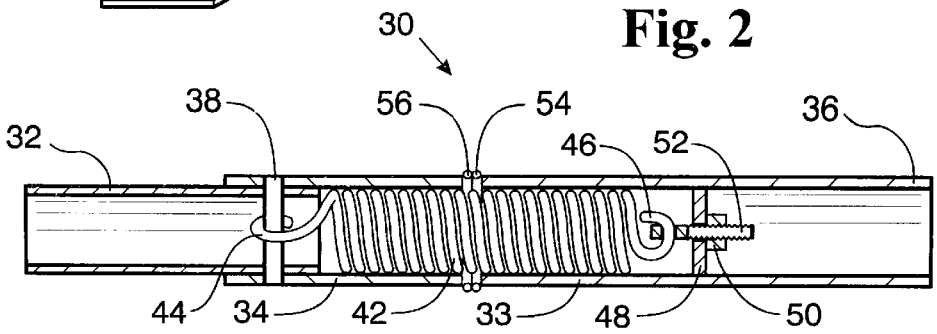
FIG. 2 illustrates a cut-away view of a first embodiment of the flex joint.

A coupling 30 having a first embodiment of the directional means is shown in FIG. 2 and is used to connect adjacent rail members. Flex joint 30 is comprised of a pair of hollow members 33 and 34 having their respective ends 54 and 56 adjacent to one another. It can be seen that the distal end 36 of hollow member 33 has a larger outside diameter than the distal end 32 of hollow member 34. The different sized ends of flex joint 30 is necessary to properly couple to adjacent rail ends as will be discussed later.

A spring 42 is connects to hollow members 33 and 34. One end of spring 42 is hook-shaped 44 and secured to a transverse pin 38 which extends across the inside diameter of hollow member 34. The other end of spring 42 is also hook-shaped 46 and secured to the end of a threaded screw member 52. Screw member 52 is passed through an aperture located on transverse pin 48 and is threadably engaged on the other side of pin 48 to a nut 50. The tension of spring 42 can be adjusted by rotation of nut 50.

Figure 3:
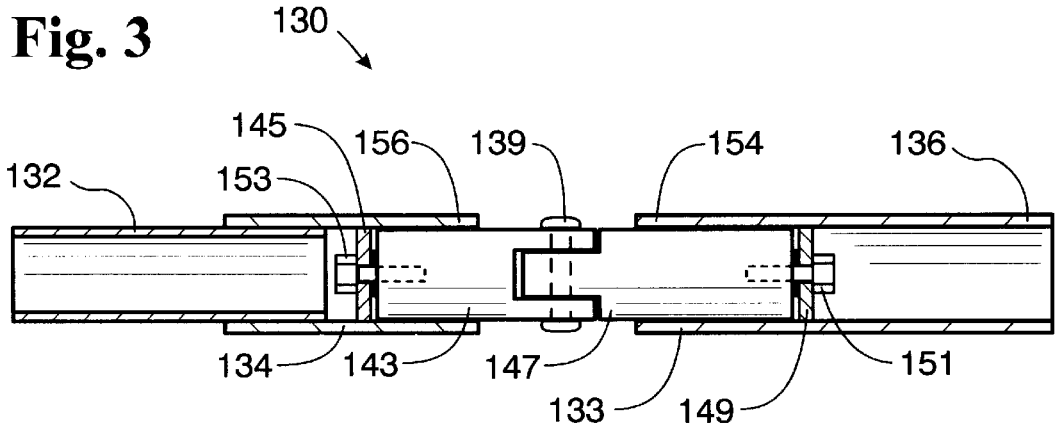
FIG. 3 illustrates a cut-away view of a second embodiment of the flex joint.

An alternative flex joint 130 having a second embodiment of the directional means is shown in FIG. 3. Flex joint 130 is comprised of a pair of members 133 and 134 having their respective ends 154 and 156 adjacent to one another. It can be seen that the distal end 136 of hollow member 133 has a larger outside diameter than the distal end 132 of hollow member 134. As with flex joint 30, the different sized ends of flex joint 130 are necessary to properly couple to adjacent rail ends.

Instead of using a spring for the directional means, flex joint 130 utilizes a rotatable hinge. Hinge members 143 and 147 are coupled to each other by hinge pin 139. Hinge members 143 and 147 can move relative to one another along one plane. The portion of hinge members 143 and 147 which extend into respective members 134 and 133 are cylindrical so that they are capable of rotation within. Member 134 has a plate or mounting pin 145 permanently attached to the inner wall of member 134. Plate 145 has a hole for passage of the stem of screw 153. Similarly, member 133 has a plate or mounting pin 149 permanently attached to the inner wall of member 133. Plate 149 has a hole for passage of the stem of screw 151. The ends of hinge members 143 and 147 distal from pin 139 have female threads for threadable engagement with respective screws 153 and 151. Once threadably engaged to screws 151 and 153, hinge members 147 and 143 are rotatable within respective members 133 and 134 and, in combination with their connection to hinge pin 139, permit flex joint 130 to be positioned in various orientations for receiving adjacent rail members.

With the components of my temporary guard rail having been adequately described, its assembly will now be explained.

Initially, stanchions 11 are first positioned and secured to the support surface or flooring through the use of lag screws 62 or the like. Proper orientation of each stanchion 11 is necessary to insure that each rail system can be supported by a respective set of brackets 20, for example, lower brackets to support a lower rail system which comprises a series of rails coupled by flex joints 30.

Also, the rails used in my invention can be of various lengths with each rail capable of being extended an additional length. It is therefore not necessary nor envisioned by my invention to require the same spacing between each stanchion 11.

Figure 5:
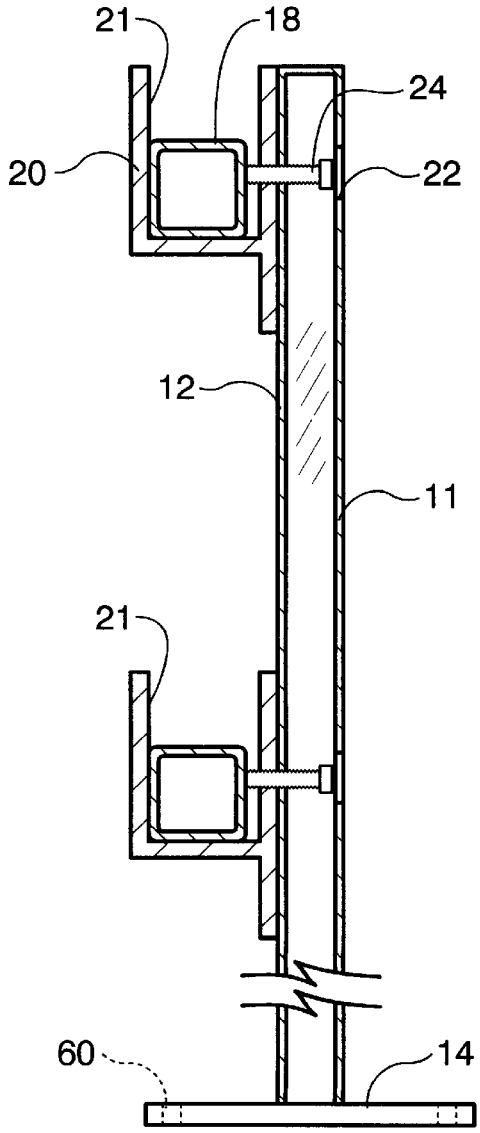
FIG. 5 illustrates the locking means for attaching rails to respective brackets.

Once stanchions 11 have been secured to the flooring, a rail will be placed upon a pair of adjacent brackets 20. Depending upon the spacing between each stanchion 11 and the positioning of the flex joint 30, a rail may need to be extended. In this case, stud 28 will require depressing so that inner rail 18 can be slidably extended from outer rail 16. Once the desired length is obtained, screws 24, located on each respective bracket 20, are used to frictionally engage the rail between screw 24 and the interior wall 21 of bracket 20 as shown in FIG. 5. It is preferred that screw 24 of one bracket 20 is in engagement with outer rail 16 while screw 24 of the other bracket supporting the rail is in engagement with inner rail 18. In this configuration, the rail can no longer be extended because the inner and outer rails are each secured.

Flex joint 30 is then slidably mounted upon the distal end of the rail. Since the ends of each rail have one end of the circumference of outer rail 16 and the other of inner rail 18, flex joint must be aligned correctly in order to couple. Therefore, distal end 36 will be coupled to one rail by sliding over inner rail 18. The other distal end 32 will be coupled to the adjacent rail by being inserted into outer rail 16.

Flex joint 30 will remain coupled to the adjacent rails so long as the outer rail 16 and inner rail 18 coupled to flex joint 30 are respectively secured to brackets 20 by screws 24.

Since flex joint 30 is a spring, it can be oriented into various directions and angles. FIG. 1 illustrates the use of flex joint 30 for a change in horizontal and vertical directions. Because a spring is used as a directional means, angles can approach close to 180 degrees in a single plane thereby allowing a wide range of application.

Other features and advantages of the invention will become apparent to those skilled in the art and various modes are contemplated as being within the scope of the following claims particularly pointing out and distinctly claiming the subject matter which is regarded as the invention.

I claim:

1. A temporary guardrail system comprising:

a plurality of stanchions, said stanchions each having a bottom end and a base having a top side and a bottom side, said base fixedly attached to the bottom end in perpendicular relation thereto, each base having a plurality of mounting apertures extending from said top side to said bottom side;

each of said stanchions further having an upper and lower bracket attached thereto, a plurality of side rails supported by the upper brackets of said stanchions;

a plurality of side rails supported by the lower brackets of said stanchions;

each said side rail comprising an outer rail member and a slidable inner rail member whereby the length of said side rails is adjustable; said slidable inner rail member further having, when in a fully retracted position, a distal end which protrudes from said outer rail member;

each of said side rails having an end defining an opening opposing an opening in another of said side rails; and, a plurality of coupling members, each coupling member having a pair of end sections, each said end section sized to be partially inserted within the opposing openings, each said coupling member further comprising a directional means disposed between said pair of end sections, said directional means capable of positioning the respective end sections of the coupling members partially within the opposing openings of adjacent side rails which are orientated in different vertical and horizontal positions.

2. The guardrail system of claim 1 where said directional means comprises a hinge having a first end and a second end distal from each other, said first ends and seconds ends each rotatably connected to a respective adjacent said end section.

3. The guardrail system of claim 2 further comprising a means to secure each of said side rails to a respective one of the brackets.

4. The guardrail system of claim 1 further comprising a temporary attachment means to maintain a relative position of said inner rail member partially within said outer rail member.

5. The guardrail system of claim 4 where said directional means comprises a hinge having a first end and a second end distal from each other, said first ends and seconds ends each rotatably connected to a respective adjacent said end section.

6. The guardrail system of claim 4 where said directional means comprises a spring.

7. The guardrail system of claim 4 further comprising a means to secure each of said side rails to a respective one of the brackets.

8. The guardrail system of claim 1 where said directional means comprises a spring.

9. The guardrail system of claim 1 further comprising a means to secure each of said side rails to a respective one of the brackets.

* * * * *